US006164511A

United States Patent [19]

Chung et al.

[11] Patent Number: 6,164,511

[45] Date of Patent: Dec. 26, 2000

[54] APPARATUS FOR MOVING A STAPLER TO A STAPLING POSITION

[75] Inventors: Jae-Heon Chung, Kyoungki-do; Seung-Kyoon Noh, Seoul, both of Rep. of Korea

[73] Assignee: Sindoricoh Co., Ltd., Seoul, Rep. of Korea

[21] Appl. No.: 09/429,112

[22] Filed: Oct. 28, 1999

[30] Foreign Application Priority Data

Oct. 31, 1998 [KR] Rep. of Korea ..... 98-46599

[51] Int. Cl.[7] ..... B25C 7/00

[52] U.S. Cl. ..... 227/148; 227/111; 227/131; 270/37; 270/58.08; 399/410

[58] Field of Search ..... 227/111, 110, 227/148, 6, 131; 399/410; 270/39, 58.08, 58.13–14, 58.11

[56] References Cited

U.S. PATENT DOCUMENTS

| | | | |
|---|---|---|---|
| H1842 | 3/2000 | Tontarski | 227/110 |
| 3,894,670 | 7/1975 | Giebel | 227/110 |
| 5,098,074 | 3/1992 | Mandel et al. | 270/58.13 |
| 5,129,640 | 7/1992 | Kosaka et al. | 270/58.08 |
| 5,255,902 | 10/1993 | Coombs | 270/58.14 |
| 5,330,170 | 7/1994 | Uotani et al. | 270/58.08 |
| 5,447,298 | 9/1995 | Watanabe et al. | 270/58.11 |
| 5,573,233 | 11/1996 | Hirai et al. | 270/58.08 |
| 5,662,318 | 9/1997 | Harada et al. | 227/111 |
| 5,709,376 | 1/1998 | Ushirogata | 399/410 |
| 5,772,197 | 6/1998 | Aoki et al. | 270/58.08 |
| 5,842,624 | 12/1998 | Ishida | 227/111 |
| 6,092,712 | 7/2000 | Rueckl | 227/110 |

*Primary Examiner*—Peter Vo
*Assistant Examiner*—Jim Calve
*Attorney, Agent, or Firm*—Oblon, Spivak, McClelland, Maier & Neustadt, P.C.

[57] ABSTRACT

The present invention provides an apparatus capable of selectively stapling one of opposite corners of the sheets, as well as a side of the sheets. And, the apparatus for moving a stapler to a stapling position comprises a track board having a guide slot, wherein the guide slot includes a longitudinal portion parallel to a side of the sheets and a plurality of slant portions slanted toward the corners of the sheets at ends of the longitudinal portion; a carrying means for fixing the stapler to upper portion thereof, the carrying means being moved along the guide slot and having a plurality of protrusions passing through the guide slot; a guide bar being disposed under the track board in parallel to the longitudinal portion, the guide bar being longer than the longitudinal portion; a driving means for providing a driving force; and a moving means, joined to the driving means, being moved along the guide bar by the driving force, the moving means having a plurality of circular arc-shaped openings for confining the protrusions moving along the longitudinal portion and providing a rotation passage of the protrusions at ends of the longitudinal portion.

16 Claims, 7 Drawing Sheets

APPARATUS FOR MOVING A STAPLER TO A STAPLING POSITION

FIELD OF THE INVENTION

The present invention relates to an apparatus for moving a stapler to staple sheets discharged from a sheet outlet in an image forming apparatus. More particularly, it relates to an apparatus capable of moving the stapler along a side of the sheets and slantingly moving the stapler toward either one corner of opposite corners of the sheets.

DESCRIPTION OF THE PRIOR ART

Generally, a finisher positioned adjacent to a sheet outlet of an image forming apparatus, such as copying machine, facsimile, printer and so on, successively loads sheets discharged from the image forming apparatus through the sheet outlet into a tray. In these prior apparatuses, if a bundle of sheets is completely loaded into the tray, the finisher automatically moves a stapler to a predetermined stapling position and operates the stapler.

The apparatus for operating the stapler of the finisher is disclosed in U.S. Pat. No. 5,098,074. In the apparatus of U.S. Pat. No. 5,098,074, the stapler slantingly staples only one corner of the sheets so that user can easily turn and read each sheet of the bundle of sheets stapled by the stapler.

Another apparatus for operating the stapler is also disclosed in U.S. Pat. No. 5,255,902. In the apparatus of U.S. Pat. No. 5,255,902, the stapler moves in parallel to a side of the sheets and staples one or more positions of the side of the sheets.

However, since each of the conventional apparatuses has its specified stapling characteristic, there is a problem that user must select apparatus having a stapling characteristic suitable to his preference and cannot use other stapling function(s) except that of the selected apparatus.

Therefore, in order to overcome the problem, Ricoh Co. Ltd. has manufactured a staple sorter (model No. A377) capable of stapling all of a side and a corner of the sheets and has dealt the product since Apr. 23, 1993.

Hereinafter, the conventional apparatus manufactured by the Ricoh Co. Ltd. will be schematically described, with referring to FIG. 1.

As shown in FIG. 1, the conventional apparatus comprises a track board 10 having a guide groove 20 for guiding movement of a stapler 30. The guide groove 20 consists of a longitudinal portion 22 parallel to a side of sheets 1 and a slant portion 24 slanted toward a corner adjacent to the side of the sheets 1.

The stapler 30 is fixed to upper surface of a carrier 40 disposed on the track board 10. The carrier 40 is fixed to a rotating belt 50 disposed on track board 10. The rotating belt 50 is connected to a motor 60 and is rotated by a driving force of the motor 60. In this case, the rotating belt 50 is supported by a plurality of free wheels 52 disposed at equal distances from the central axis of the longitudinal portion 22 on the track board 10. Therefore, the rotating belt 50 is positioned in parallel to the guide groove 20.

The carrier 40 is moved along the guide groove 20 when the rotating belt 50 rotates in the right or left direction. The carrier 40 has a plate 42 fixing the stapler 30 thereto, two protrusions 44 formed on lower surface of the plate 42, a plurality of casters 46 disposed on lower surface of the plate 42 and contacted to the track board 10, and a fixed piece 48 formed on a corner of the plate 42. In this case, the fixed piece 48 is fixed to a portion of the rotating belt 50.

Each of the protrusions 44 has a roller 70 disposed on lower portion thereof. External diameter of each of the rollers 70 is substantially equal to inner width of the longitudinal portion 22. The rollers 70 prevent the carrier 40 from being shaken or separated from the guide groove 20 during moving.

The conventional apparatus structured as above-mentioned is operated as follows.

For stapling a side of the sheets 1 loaded into a tray (not shown), the motor 60 drives and provides the driving force for the rotating belt 50, thereby rotating the belt 50. Then, the carrier 40 fixed to the belt 50 by the fixed piece 48 is successively moved in "C " direction along the longitudinal portion 22 until the stapler 30 fixed to the carrier 40 is positioned at the required stapling position. Thereafter, when the stapler 30 reaches the stapling position, the motor 60 stops and the stapler 30 operates in order to staple the side of the bundle of the sheets 1. Then, the motor 60 again drives to provide the driving force, thereby moving the stapler 30 to the next stapling position. Thereafter, the motor 60 stops and the stapler 30 staples the bundle of the sheets 1 at the next stapling position. The stapling process as described above is successively repeated by times assigned by the user.

On the other hand, for stapling one corner of the bundle of sheets 1, the motor 60 drives and provides the driving force for the belt 50, thereby rotating the belt 50 so that the carrier 40 is moved in "C" direction. Thereafter, at end of the longitudinal portion 22, the carrier 40 rotates in "D" direction along the slant portion 24 and moves from the longitudinal portion 22 to the slant portion 24. Then, when the right protrusion 44 of the carrier 40 enters the slant portion 24, the fixed piece 48 may be separated from the belt 50. Therefore, the motor 60 stops before the right protrusion 44 enters the slant portion 24. In this state, the stapler 30 operates in order to staple the corner of the bundle of the sheets 1.

In this case, a slant angle of the staple stuck into the sheets depends on angle between the longitudinal and slant portions.

In the both cases, for performing the stapling process, the sheets 1 to be stapled move in "A" direction and the stapled sheets come off in "A'" direction after completing the stapling process; otherwise the track board 10 with the stapler 30 moves toward the sheets 1 to be stapled in "B" direction and the track board 10 comes off in "B'" direction after completing the stapling process.

However, since the recent image forming apparatus, such as digital copying machine, digital printer and so on, can displace a position of an image copied to the sheets by diminishing or magnifying the images, the apparatus must selectively move the stapler to any one of opposite corners of the sheets depending on position of the image but the conventional apparatus has a problem that the stapler cannot help moving to only one corner of the sheets.

In order to overcome the problem, even though two fixed pieces fixed to the belt are formed on ends of the plate 42 and the slant portions are formed on ends of the longitudinal portion, one of the fixed pieces may be separated from the belt while the carrier rotates along one of two slant portions. Therefore, since the conventional apparatus has only one slant portion and one fixed piece, the stapler cannot selectively move to either one of opposite corners of the sheets.

SUMMARY OF THE INVENTION

It is, therefore, an object of the present invention to provide an apparatus for moving a stapler capable of selectively stapling either one of opposite corners of the sheets as well as a side of the sheets, in an image forming apparatus.

In accordance with an aspect of the present invention, there is provided an apparatus comprising a track board having a guide slot, wherein the guide slot includes a longitudinal portion parallel to a side of the sheets and a plurality of slant portions slanted toward the corners of the sheets at ends of the longitudinal portion; a carrying means for fixing the stapler to upper portion thereof, the carrying means being moved along the guide slot and having a plurality of protrusions passing through the guide slot; a guide means being disposed under the track board in parallel to the longitudinal portion, the guide means being longer than the longitudinal portion; a driving means for providing a driving force; and a moving means, joined to the driving means, being moved along the guide means by the driving force, the moving means having a plurality of circular arc-shaped openings for confining the protrusions moving along the longitudinal portion and providing a rotation passage of the protrusions at ends of the longitudinal portion.

BRIEF DESCRIPTION OF THE DRAWINGS

The above and other objects and features of the present invention will become apparent from the following description of the preferred embodiments given in connection with the accompanying drawings, in which.

DETAILED DESCRIPTION OF THE PREFERRED EMBODIMENTS

Hereinafter, the present invention will be described in detail referring to the accompanying FIGS. 2 through 7.

Figure 1:
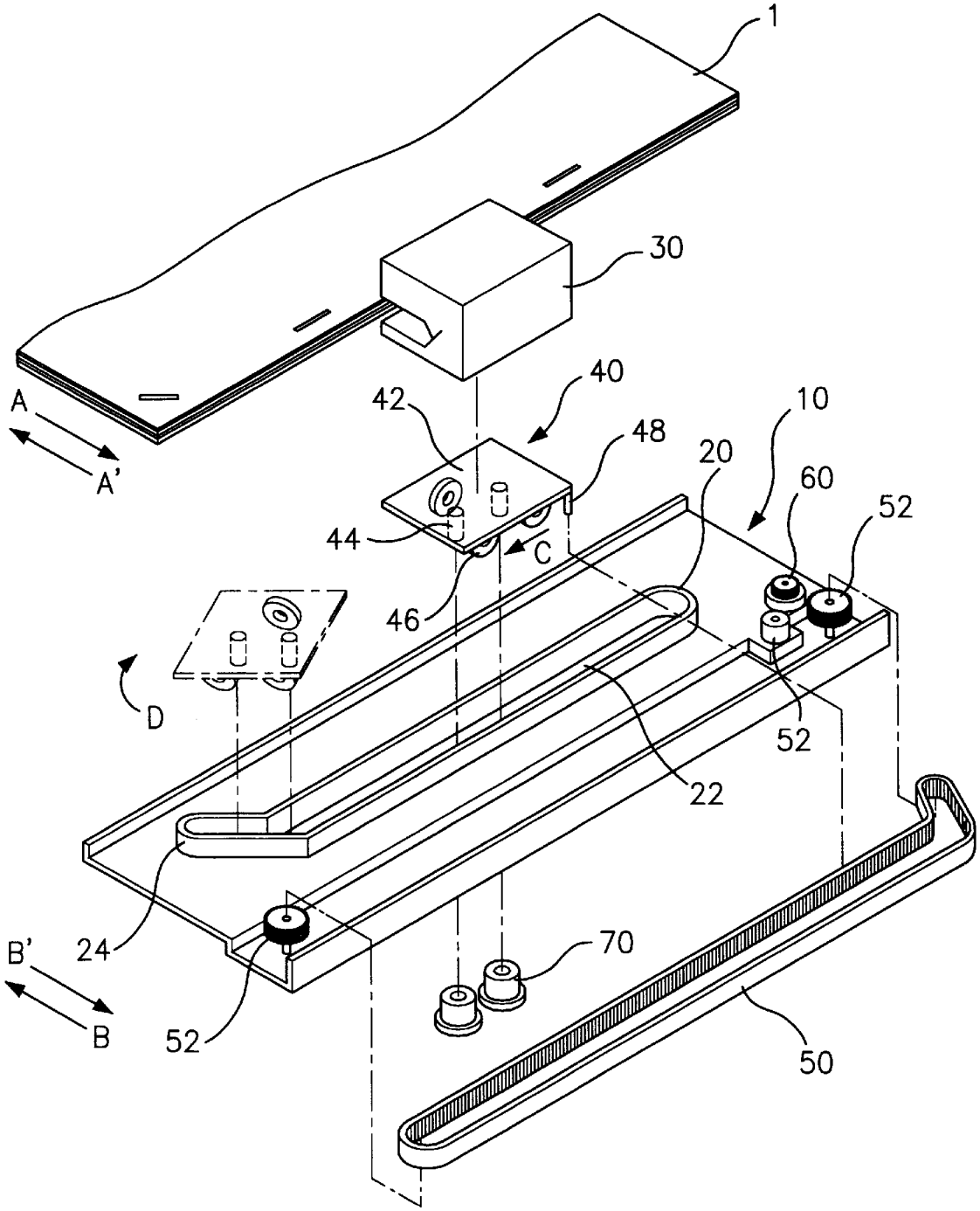
FIG. 1 PRIOR ART
FIG. 1 shows structure of a conventional apparatus for moving a stapler.
Figure 2:
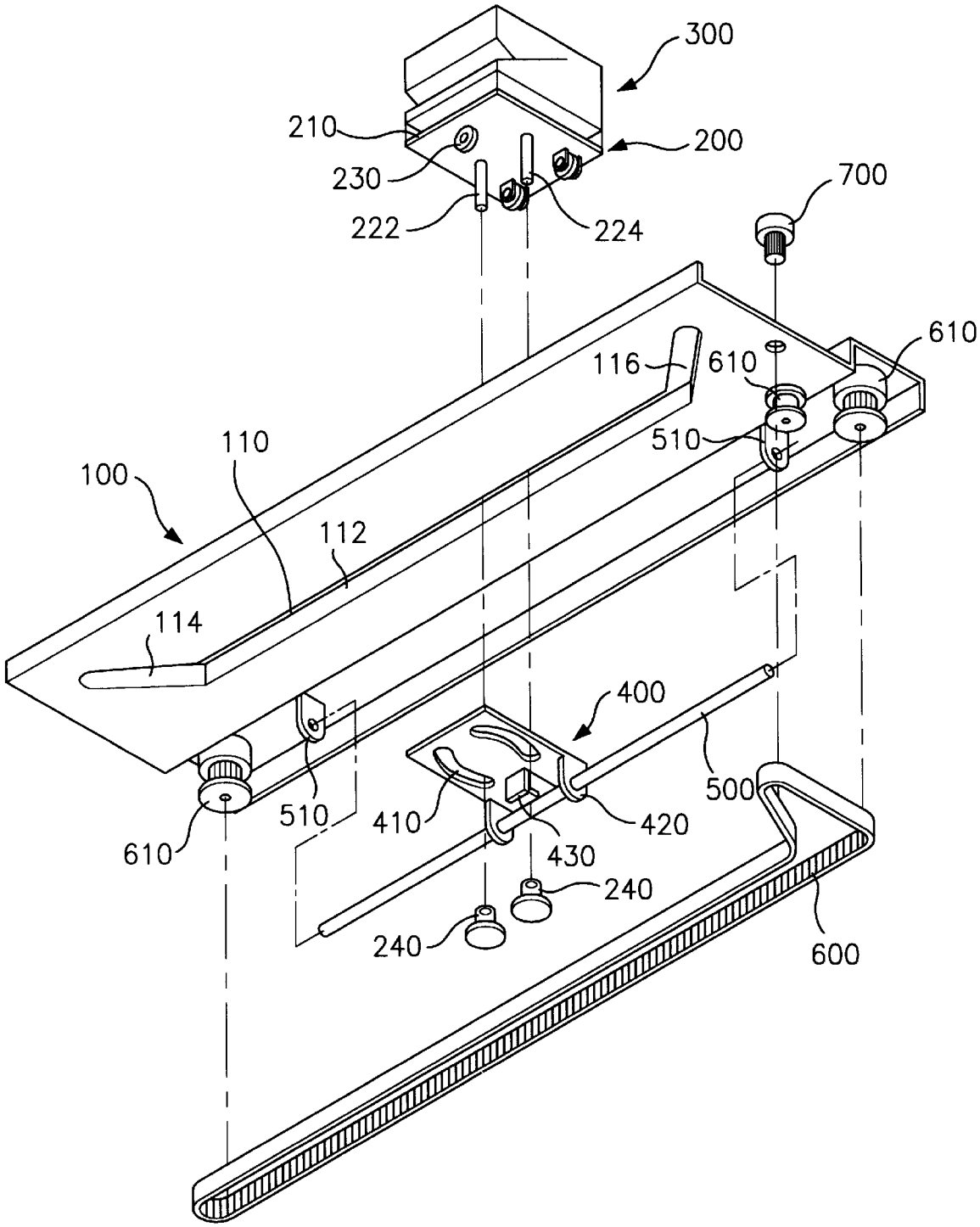
FIG. 2 represents structure of an apparatus for moving a stapler according to an embodiment of the present invention.

As shown in FIG. 2, the apparatus according to an embodiment of the present invention comprises a track board 100 having a guide slot 110 and a carrier 200 movably disposed on the guide slot 110.

The track board 100 is a rectangular-shaped plate of which longitudinal axis is parallel to a side of the sheets to be stapled. In this case, the guide slot 110 has a longitudinal portion 112 parallel to the side of the sheets and a first and second slant portions 114 and 116, which are respectively inclined toward corners of the side of the sheets at ends of the longitudinal portion 112.

The carrier 200 has a plate 210 fixing a stapler 300 to upper surface thereof, a first and second protrusions 222 and 224 formed on lower surface of the plate 210 to pass through the guide slot 110, and a plurality of casters 230 disposed on lower surface, or both sides, of the plate 210 to be contacted to upper surface of the track board 100.

The carrier 200 is joined to a moving plate 400 disposed under the track board 100. The moving plate 400 is movably disposed on a guide bar, or rod 500 supported by two brackets 510 disposed on both sides of lower surface of the track board 100.

The moving plate 400 has two circular arc-shaped openings 410 for respectively confining lower end of each of the protrusions 222 and 224. Preferably, the two circular arc-shaped openings 410 have a same radius of curvature.

Further, the lower end of each of the protrusions 222 and 224 is fitted with roller 240 having external diameter substantially equal to width of the circular arc-shaped opening 410. In this case, the protrusions 222 and 224 may smoothly rotate along the circular arc-shaped openings 410 by the roller 240. Preferably, the rollers 240 consist of a plastic or a vinyl resin having a relatively small surface friction factor.

The moving plate 400 also has two brackets 420 respectively formed on both sides of the lower surface thereof and a latch 430 disposed on the lower surface thereof.

The two brackets 420 respectively have a through hole opposite to each other. The guide bar 500 passes the two through holes. The guide bar 500 is positioned in parallel to the longitudinal portion 112 and is longer than the longitudinal portion 112. Therefore, both ends of the guide bar 500 exceed both ends of the longitudinal portion 112.

The latch 430 of the moving plate 400 is fixed to a portion of a rotating belt 600 disposed on lower portion of the track board 100.

Both ends of the rotating belt 600 are respectively supported by a plurality of free wheels 610 disposed on edges of the track board 100 so that the rotating belt 600 is positioned in parallel to the longitudinal portion 112 and the guide bar 500. Preferably, entire inner surface of the belt 600 may consist of uneven surface and outer surfaces of two free wheels 610 contacted to the inner surface of the belt 600 may consist of uneven surface engaging with the belt 600. In this case, the guide bar 500 is positioned on inside of the rotating belt 600, thereby miniaturizing entire size of the apparatus.

The rotating belt 600 is driven by driving force from a motor 700, thereby rotating. Then, the motor 700 may drive in the right or left direction, and is connected to the rotating belt 600. A drive shaft of the motor 700 may be directly engaged with the rotating belt 600. Otherwise, any one of the free wheels 610 functions as a driving wheel and the drive shaft of the motor 700 is joined to the driving wheel.

Hereinafter, operation of the apparatus according to the embodiment will be described in detail, with referring to FIGS. 3 to 6.

Figure 3:
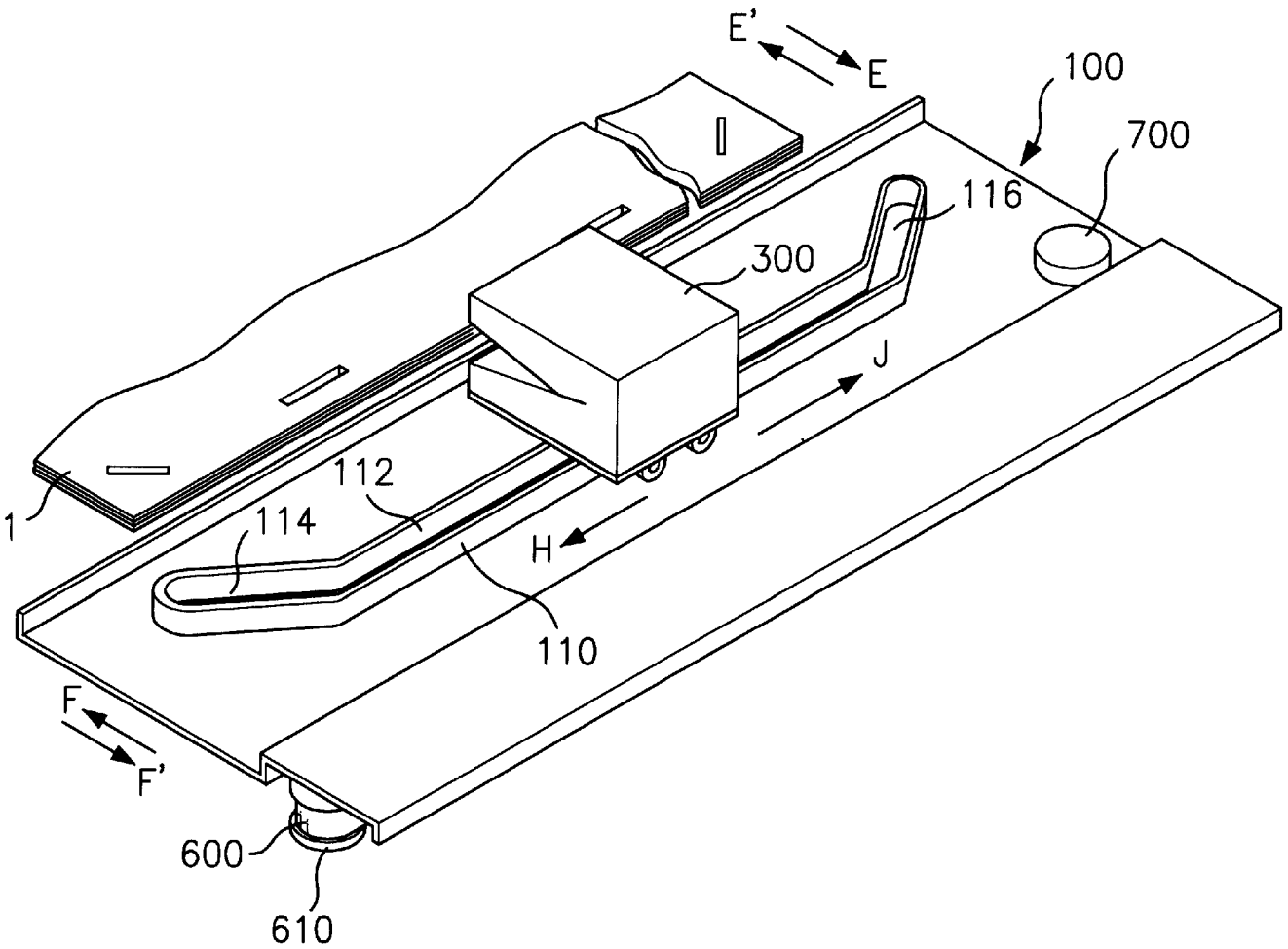
FIG. 3 illustrates operation of the apparatus for moving a stapler according to the embodiment of the present invention.

As shown in FIG. 3, when a tray (not shown) completely loads a bundle of sheets 1 discharged from the image forming apparatus, the bundle of sheets 1 is moved in "E" direction or the track board 100 with the stapler 300 of this embodiment is moved in "F" direction, thereby positioning the stapler 300 at the required stapling position. On the contrary, when stapling process is completed, the bundle of sheets 1 is moved in "E'" direction or the track board 100 is moved in "F'" direction.

Figure 4:
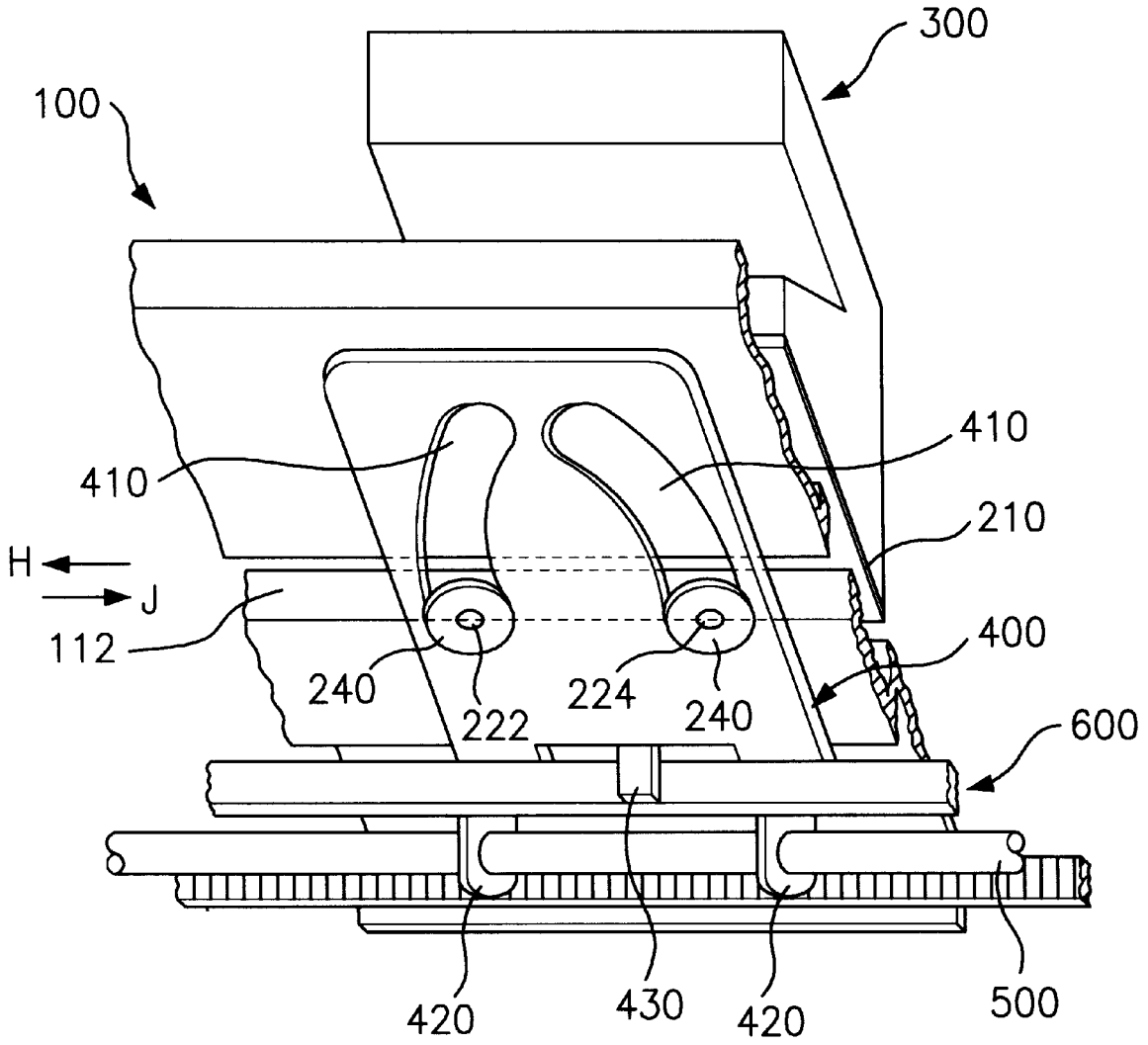
FIG. 4 depicts a state that a moving plate moves along a longitudinal portion of the embodiment.

Further, for stapling a side of the sheets 1, as shown in FIG. 4, the motor 700 drives and rotates the belt 600. Then, the moving plate 400 fixed to a portion of the belt 600 is moved in "H" or "J" direction along the guide bar 500, thereby moving the carrier 200 connected to the moving plate 400. In this case, the carrier 200 is moved along the longitudinal portion 110 parallel to the side of the sheets 1.

The casters 230 roll on the upper surface of the track board 100, thereby moving the carrier 200 smoothly. In this state, when the stapler 300 is positioned at the stapling position, the motor 700 stops and the stapler 300 operates to staple the bundle of sheets 1. In this case, a staple stuck in the sheets 1 is substantially parallel to the side of the sheets 1.

For stapling the side of the sheets 1 more than two times, after completing the first stapling process, the motor 700 again drives and moves the stapler 300 to the next stapling position. Thereafter, when the stapler 300 is positioned at the next stapling position, the motor 700 stops and the stapler 300 again operates to staple the side of the bundle of sheets. The stapling process as above-mentioned is repeated by a predetermined times intended by the user.

Figure 5:
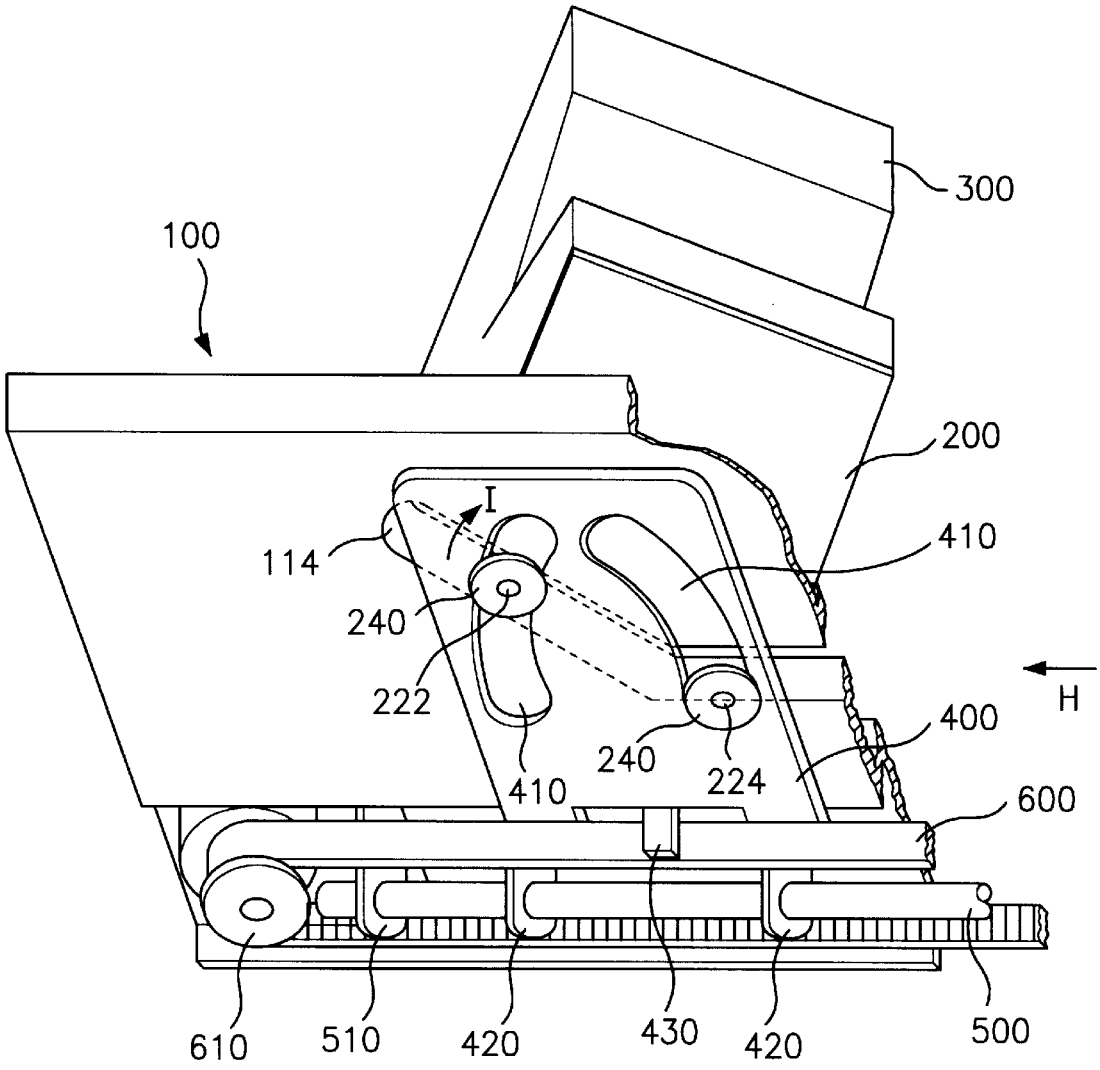
FIG. 5 depicts a state that a carrier rotates at a first slant portion of the embodiment.

Further, for stapling corner of the sheets 1 adjacent to the first slant portion 114, as shown in FIG. 5, the motor 700 drives in the left direction and rotates the belt 600. Then, the moving plate 400 fixed to a portion of the belt 600 is moved in "H" direction along the guide bar 500, thereby moving the carrier 200 connected to the moving plate 400 together with the stapler 300. Thereafter, when the first protrusion 222 enter the first slant portion 114, the first protrusion 222 rotates in "I" direction along the circular arc-shaped opening and the second protrusion 224 positioned on the longitudinal portion 112 functions as center axis of the rotation. Therefore, the stapler 300 fixed to the carrier 200 is slantingly positioned on the corner of the sheets 1. In this state, the motor 700 stops and the stapler 300 operates to staple the bundle of sheets 1. Then, a staple stuck into the sheets 1 inclines by an angle substantially equal to that between the longitudinal portion 112 and the first slant portion 114.

Figure 6:
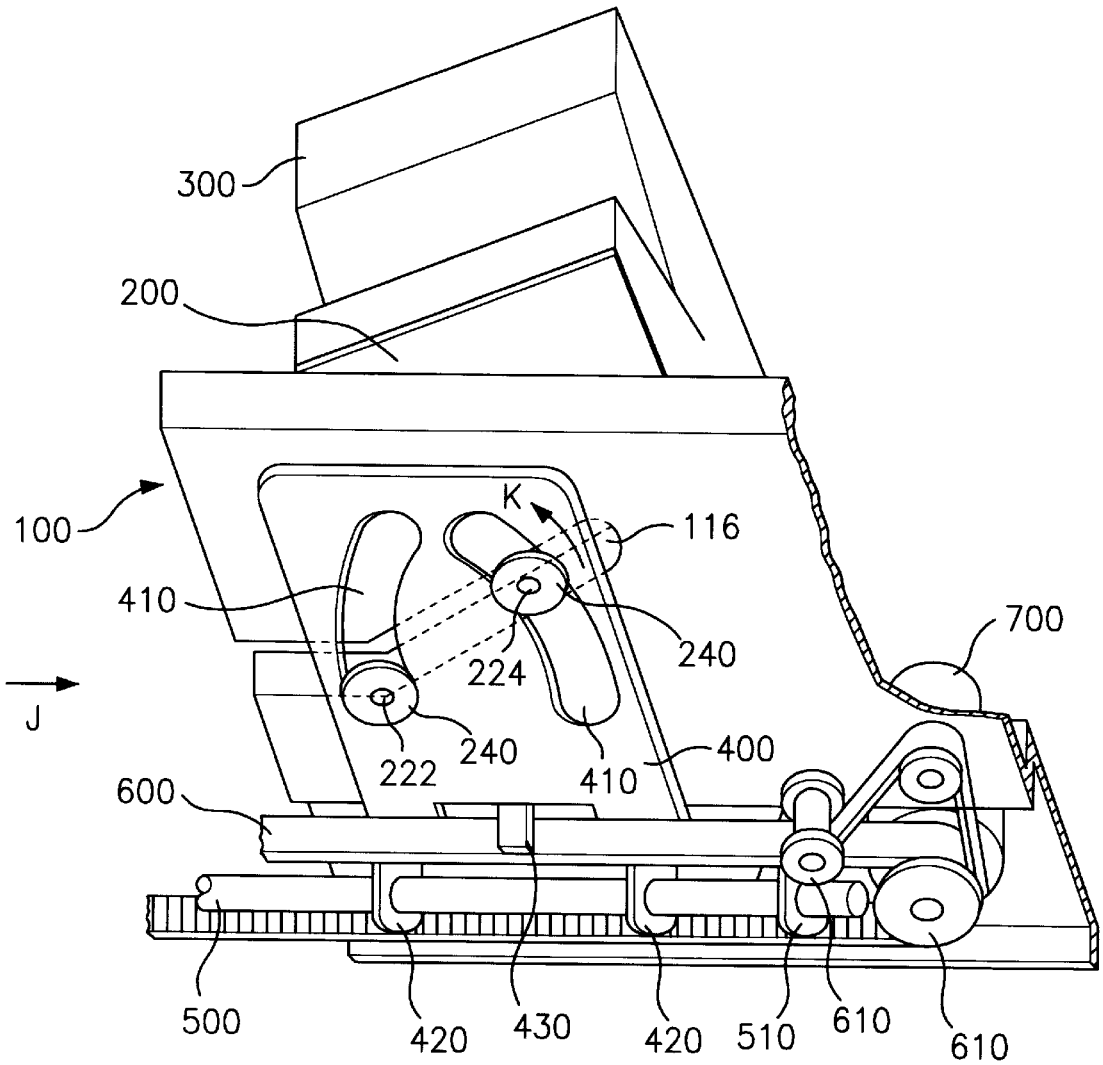
FIG. 6 shows a state that the carrier rotates at a second slant portion of the embodiment.

On the contrary, for stapling the opposite corner of the sheets 1 adjacent to the second slant portion 116, as shown in FIG. 6, the motor 700 drives in the right direction and rotates the belt 600. Then, the moving plate 400 fixed to a portion of the belt 600 is moved in "J" direction along the guide bar 500, thereby moving the carrier 200 connected to the moving plate 400 together with the stapler 300. In this case, when the second protrusion 224 enters the second slant portion 116, the second protrusion 224 rotates in "K" direction along the circular arc-shaped opening and the first protrusion 222 positioned on the longitudinal portion 112 functions as center axis of the rotation. Therefore, the stapler 300 fixed to the carrier 200 is slantingly positioned on the corner of the sheets 1. In this state, the motor 700 stops and the stapler 300 operates to staple the bundle of sheets 1. Then, a staple stuck into the sheets 1 inclines by an angle substantially equal to that between the longitudinal portion 112 and the second slant portion 116.

Figure 7:
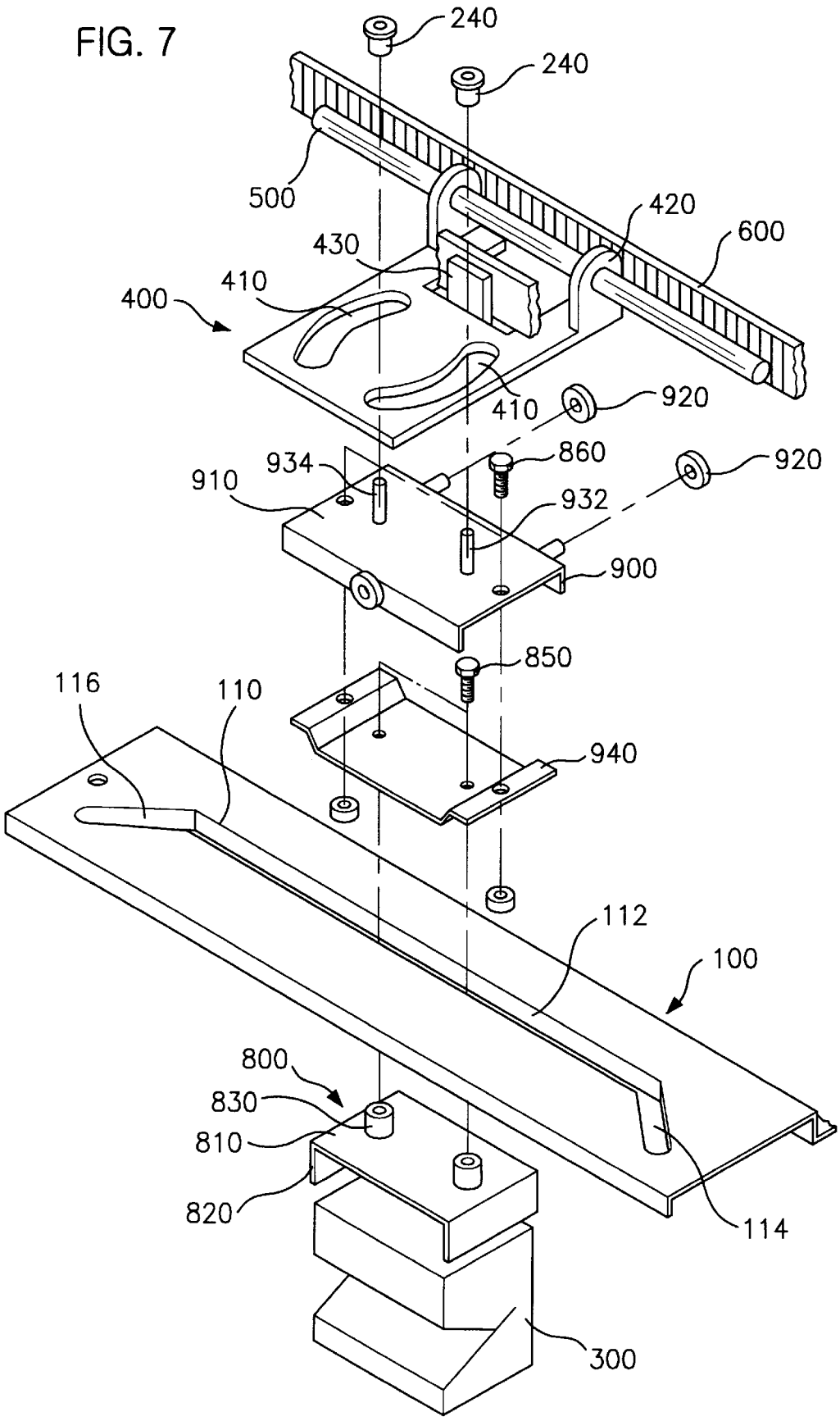
FIG. 7 represents structure of an apparatus for moving a stapler according to another embodiment of the present invention.

FIG. 7 shows another embodiment of the present invention, which the stapler is positioned on lower portion of the apparatus. Before describing this embodiment, it is noted that with regard to parts of this embodiment similar or substantially equal to the previous embodiment are omitted detailed descriptions and used a same reference numerals as the previous embodiment.

As shown in FIG. 7, a the apparatus according to another embodiment of the present invention comprises a track board 100, a stapler 300, a moving plate 400, a guide bar 500, a rotating belt 600 and a motor(not shown) described in the previous embodiment. In this embodiment, the track board 100 is positioned under the moving plate 400, the guide bar 500 and the rotating belt 600.

Further, this embodiment has a stand 800 positioned under the track board 100. The stand 800 has a flat portion 810, two erect portions 820 downwardly formed on both ends of the flat portion 810, and two columns 830 disposed on upper surface of the flat portion 810. The stapler 300 is fixed between the two erect portions 820. Each of the columns 830 longitudinally has a hole forming a screw thread on inner surface. The columns 830 have a predetermined length to pass through the guide slot 110 from the downside to the upside. In this case, the upper end of each of the columns 830 is joined to bracket 940 positioned on the guide slot 110 by a screw 850.

Furthermore, the bracket 940 is joined to a carrier 900 positioned under the moving plate 400. In this case, the bracket 940 and carrier 900 respectively have a plurality of through holes formed in their both sides. The through holes of the bracket 940 are faced to the through holes of the carrier 900. Therefore, the bracket 940 and carrier 900 are joined to each other by screw 860 passing through the opposite through holes and the screw 860 is fixed by nut.

The carrier 900 has a main body 910 joined to the bracket 940, a plurality of wheels 920 rotatively fitted to both sides of the main body 910 and a first and second protrusions 932 and 934 formed on upper surface of the main body 910. The wheels 920 are contacted to upper surface of the track board 100. Since the wheels 920 roll the track board 100 during movement of the carrier 900, the carrier 900 may smoothly move. The protrusions 932 and 934 are respectively confined by the circular arc-shaped openings 410 of the moving plate 400. Also, the upper end of each of the protrusions 932 and 934 is fitted with roller 240 having external diameter substantially equal to one of circular arc-shaped openings 410, as the previous embodiment. Preferably, the first protrusion 932 and one of the column 830 adjacent to the protrusion 932 are coaxial, and the second protrusion 934 and the other column 830 adjacent to the protrusion 934 are also coaxial.

As modification of this embodiment, the bracket 940 and the carrier 900 may be integrally manufactured. In this case, the wheels 920 may be disposed on lower portion of the carrier 900.

Since operation of this embodiment structured as described above is similar to that of the previous embodiment, the description of the operation of this embodiment is omitted.

Since the apparatus as described above can selectively staple a side or opposite corners of the sheets depending on the position of the image copied on the sheets discharged from the image forming apparatus, it may satisfy the user's requirement.

While the present invention has been described with respect to certain preferred embodiments only, other modifications and variation may be made without departing from the spirit and scope of the present invention as set forth in the following claims.

What is claimed is:

1. An apparatus for moving a stapler to stapling position, comprising:

a track board having a guide slot, wherein said guide slot includes a longitudinal portion parallel to a side of sheets and a plurality of slant portions slanted toward corners of the sheets at ends of said longitudinal portion;

a carrying means for fixing said stapler to an upper portion thereof, said carrying means being moved along said guide slot and having a plurality of protrusions passing through said guide slot;

a guide means being disposed under said track board in parallel to said longitudinal portion, said guide means being longer than said longitudinal portion;

a driving means for providing a driving force; and a moving means, joined to said driving means, being moved along said guide means by the driving force, said moving means having a plurality of circular arc-shaped openings for confining said protrusions moving along said longitudinal portion and providing a rotation passage of the protrusions at ends of said longitudinal portion.

2. The apparatus as recited in claim 1, wherein said carrying means includes a plurality of rollers rotatively disposed at said lower portion of each of said protrusions.

3. The apparatus as recited in claim 2, wherein external diameter of each of said rollers is substantially equal to width of said circular arc-shaped openings.

4. The apparatus as recited in claim 1, wherein said moving means includes a plate having said circular arc-shaped openings, a plurality of brackets having a through hole to pass said guide means therethrough and at least one latch fixed to said driving means.

5. The apparatus as recited in claim 4, wherein said driving means includes a motor generating said driving force, a belt rotated by said driving force, and a plurality of free wheels for supporting ends of said belt in parallel to said longitudinal portion, wherein said latch of said moving means is fixed to a portion of said belt.

6. The apparatus as recited in claim 1, wherein said carrying means includes at least two casters disposed at lower surface thereof and contacted to said track board.

7. An apparatus for moving a stapler to stapling position, comprising:

a track board having a guide slot, wherein said guide slot includes a longitudinal portion parallel to a side of sheets and a plurality of slant portions slanted toward corners of the sheets at ends of said longitudinal portion;

a fixing stand, disposed under said track board, for fixing the stapler to lower portion thereof, said fixing stand being moved along said guide slot;

a carrying means, positioned over said track board, being fixed to said fixing stand, said carrying means having a plurality of protrusions protruded from upper surface thereof;

a guide means being disposed over said track board in parallel to said longitudinal portion, said guide means being longer than said longitudinal portion of said track board;

a driving means for providing a driving force; and a moving means, joined to said driving means, being moved along said guide means by the driving force, said moving means having a plurality of circular arc-shaped openings for confining said protrusions moving along said longitudinal portion and providing a rotation passage of the protrusions at ends of said longitudinal portion.

8. The apparatus as recited in claim 7, wherein said fixing stand includes a plurality of columns, wherein said columns pass through said guide slot and being fixed to said carrying means.

9. The apparatus as recited in claim 8, wherein said carrying means includes a bracket fixed to upper ends of said columns passing through said guide slot, and a carrier fixed to said bracket and having said protrusions.

10. The apparatus as recited in claim 9, wherein said carrying means further includes a plurality of wheels disposed both sides thereof and contacted to said track board.

11. The apparatus as recited in claim 9, wherein said carrying means further includes a plurality of rollers disposed on said upper portion of each of said protrusions.

12. The apparatus as recited in claim 11, wherein external diameter of each of said rollers is substantially equal to width of said circular arc-shaped openings.

13. The apparatus as recited in claim 9, wherein said bracket and said carrier is integrally formed.

14. The apparatus as recited in claim 7, wherein said moving means includes a plate having said circular arc-shaped openings, a plurality of brackets having a through hole to pass said guide means therethrough and at least one latch fixed to said driving means.

15. The apparatus as recited in claim 14 wherein said moving means further includes a plurality of rollers rotatively disposed at upper portion of each of said protrusions.

16. The apparatus as recited in claim 14, wherein said driving means includes a motor generating said driving force, a belt rotated by said driving force, and a plurality of free wheels for supporting ends of said belt in parallel to said longitudinal portion, wherein said latch of said moving means is fixed to a portion of said belt.

* * * * *